US009193044B2

(12) United States Patent
Cheng

(10) Patent No.: US 9,193,044 B2
(45) Date of Patent: Nov. 24, 2015

(54) ADJUSTABLE SPANNER

(75) Inventor: Kai-Wei Cheng, Taichung (TW)

(73) Assignee: APEX TOOL (HK) LIMITED TAIWAN BRANCH, Taichung (TW)

( * ) Notice: Subject to any disclaimer, the term of this patent is extended or adjusted under 35 U.S.C. 154(b) by 729 days.

(21) Appl. No.: 13/087,761

(22) Filed: Apr. 15, 2011

(65) Prior Publication Data

US 2012/0055292 A1 Mar. 8, 2012

(30) Foreign Application Priority Data

Sep. 3, 2010 (TW) ..... 99129934 A

(51) Int. Cl.
*B25B 13/14* (2006.01)
*B25B 13/46* (2006.01)
*B25B 13/12* (2006.01)

(52) U.S. Cl.
CPC ..... *B25B 13/14* (2013.01); *B25B 13/46* (2013.01); *B25B 13/12* (2013.01)

(58) Field of Classification Search
CPC ..... B25B 13/14; B25B 13/20; B25B 13/12
USPC ..... 81/126, 165
See application file for complete search history.

(56) References Cited

U.S. PATENT DOCUMENTS

| | | | | |
|---|---|---|---|---|
| 2,562,060 | A | 7/1951 | Pehrsson | |
| 2,970,502 | A * | 2/1961 | Nordgren | 81/126 |
| 3,312,129 | A * | 4/1967 | Nordgren | 81/126 |
| 3,349,654 | A | 10/1967 | Nordgren | |
| 3,407,689 | A | 10/1968 | Slayton | |
| 3,926,077 | A * | 12/1975 | Nordgren | 81/126 |
| 6,336,384 | B1 * | 1/2002 | Huang | 81/165 |
| 6,345,555 | B1 | 2/2002 | Huang | |
| 6,418,819 | B1 * | 7/2002 | Kuo | 81/165 |
| 6,568,300 | B1 * | 5/2003 | Steffe | 81/126 |
| 6,595,089 | B1 * | 7/2003 | Stojanowski | 81/165 |
| 7,275,464 | B2 * | 10/2007 | Chervenak et al. | 81/165 |
| 8,276,484 | B2 * | 10/2012 | Huang | 81/165 |
| 2003/0200840 | A1 | 10/2003 | Yap | |

FOREIGN PATENT DOCUMENTS

| | | | |
|---|---|---|---|
| CN | 2261916 | Y | 9/1997 |
| CN | 201128127 | Y | 10/2008 |
| CN | 101391409 | A | 3/2009 |
| CN | 101468454 | A | 7/2009 |
| CN | 101570009 | A | 11/2009 |
| TW | 370910 | U | 9/1999 |
| TW | 388313 | U | 4/2000 |
| TW | 441440 | U | 6/2001 |
| TW | M268135 | U | 6/2005 |
| TW | 200740556 | A | 11/2007 |
| TW | M352428 | U | 3/2009 |
| TW | I325803 | B | 6/2010 |
| WO | 2010002239 | A1 | 1/2010 |

* cited by examiner

*Primary Examiner* — Lee D Wilson
*Assistant Examiner* — Danny Hong
(74) *Attorney, Agent, or Firm* — Nelson Mullins Riley & Scarborough, LLP

(57) ABSTRACT

An adjustable spanner for quickly turning an object includes a moving member, a first jaw, a second jaw, and a grip. The moving member is movably joined to the grip. The first jaw is adjustably jointed to the moving member. The second jaw is pivotally joined to the grip and cooperates with the first jaw to clamp the object. A user grasps the grip when using the adjustable spanner.

16 Claims, 17 Drawing Sheets

ADJUSTABLE SPANNER

BACKGROUND

1. Field of the Invention

The present invention relates to an adjustable spanner, and particularly, to an adjustable spanner for quickly turning an object.

2. Description of the Related Art

U.S. Pat. No. 6,336,384 shows an adjustable wrench for quickly turning an object. The adjustable wrench includes a main body, a slide block, a movable jaw and a grip. The main body includes a jaw section and a hollow section in which the slide block and the movable jaw are disposed. The grip is pivotally connected with the hollow section. A movable retaining block is disposed on one side of the top end of the grip and is opposite to a leaning section of the slide block. The retaining block can be switched, whereby when the grip is wrenched in different directions, the retaining block pushes the leaning section of the slide block so as to change the one-way wrenching direction of the adjustable wrench during repeated wrenching operation for an object. However, since the retaining block is movable and an engagement between the leaning section of the slide block and the retaining block is not secure, it is difficult to prevent the retaining block from moving relative to the slide block. Likewise, a detent ball, which is biased by a spring, is liable to disengage from a recessed section of the grip and the arrangement may not be suitable where relatively large torque forces are required. Also, assembly of this adjustable wrench may be different.

One or more embodiments of the present invention may address these and/or other aspects of the prior art.

SUMMARY OF THE INVENTION

In one embodiment of the present invention, an adjustable spanner for quickly turning an object includes a moving member, a first jaw adjustably jointed to the moving member, a second jaw cooperating with the first jaw, and a grip including a first end a user grasps when using the adjustable spanner and a second end opposite to the first end. The moving member is movably joined to the second end, and movement thereof is restricted by a first fastening device. The first fastening device is moveable in a slot defined in the moving member, is biased by an elastic member disposed in the slot, and is also fixed to the second end. Additionally, the second jaw is pivotally joined to the second end by a second fastening device. The second fastening device is inserted in the second end and the second jaw.

The adjustable spanner is able to be turned in a first direction that an object held between the first and second jaws is turned, with a relative position between the first and second jaws fixed, with a fixed first clamping distance defined between the first and second jaws. In addition, the moving member is not moved relative to the grip, and the first fastening device is restricted from movement in this operation.

Furthermore, the adjustable spanner is capable of being turned relatively to the object, in a second direction which is opposite to the first direction. In this operation, the moving member moves relative to the grip while the first fastening device moves in the slot and urges the elastic member, with the first jaw carried by the moving member to move away from the second jaw until the moving member and first fastening device stop, with a second clamping distance larger than the first clamping distance defined between the first and second jaws when the moving member stops, and with the moving member being able to return to the relative position where the first and second jaws define the first clamping distance by the elastic member.

It is an object of an embodiment of the present invention to provide an adjustable spanner for quickly turning an object, and it has a satisfactory structural strength.

It is another object of the present invention to provide an adjustable spanner that may be used in a circumstance which requires a relatively large torque to turn an object.

It is a further object of an embodiment of the present invention to allow elements of the adjustable spanner to be installed easily.

DETAILED DESCRIPTION OF PREFERRED EMBODIMENTS

Figure 1:
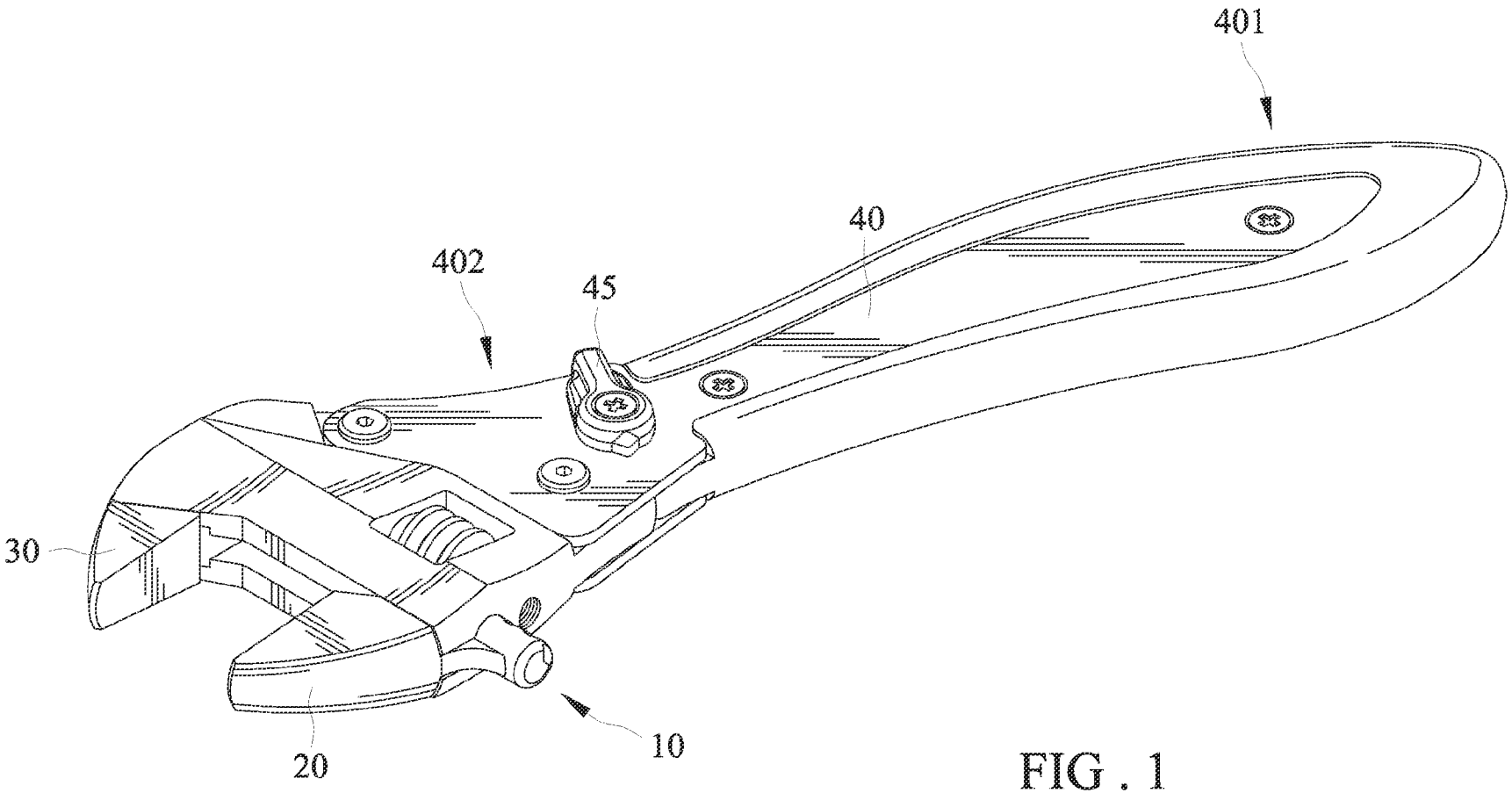
FIG. 1 is a perspective view of an adjustable spanner for quickly turning an object in accordance with a first embodiment of the present invention.
Figure 2:
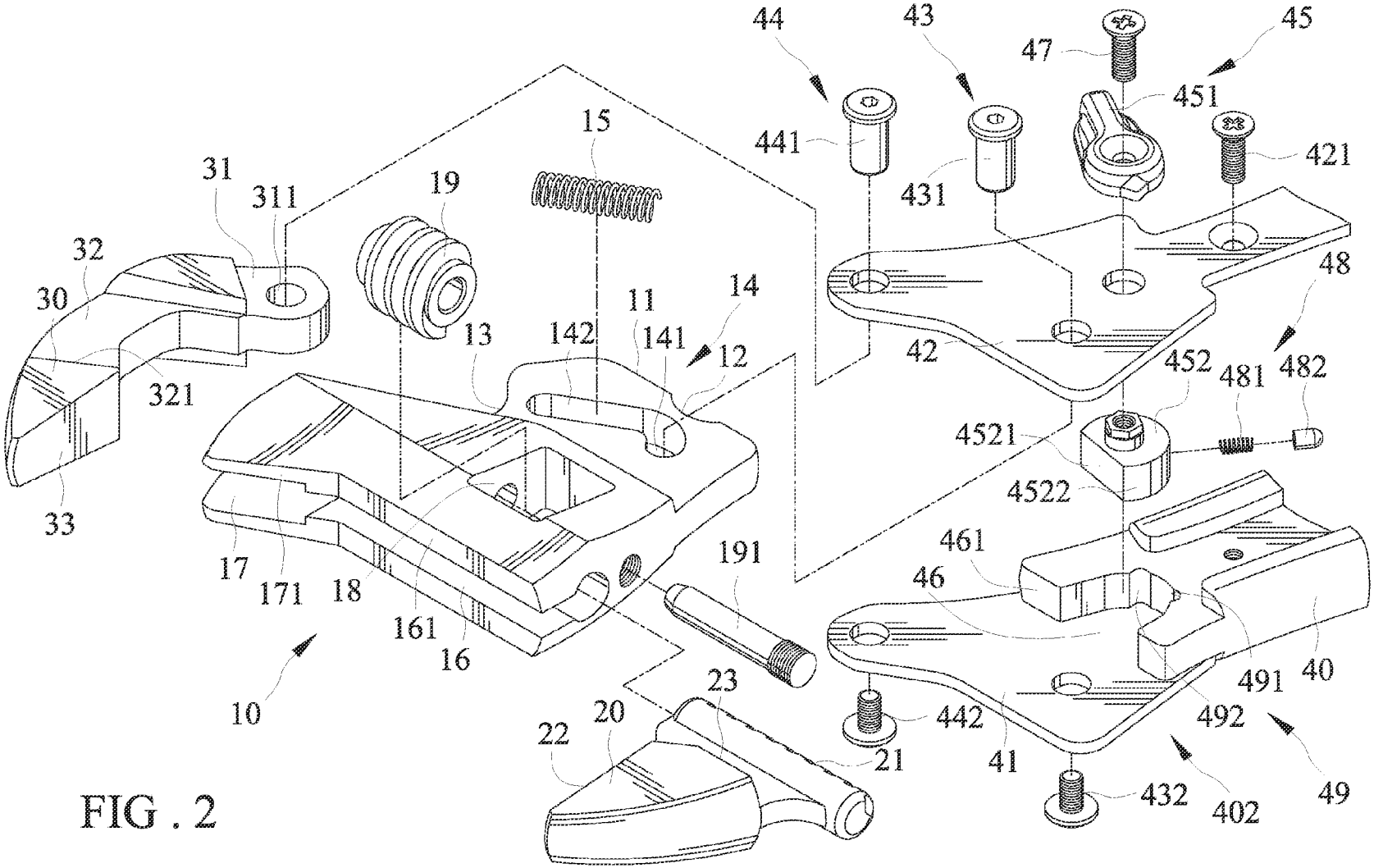
FIG. 2 is an exploded perspective view of the adjustable spanner of FIG. 1.
Figure 3:
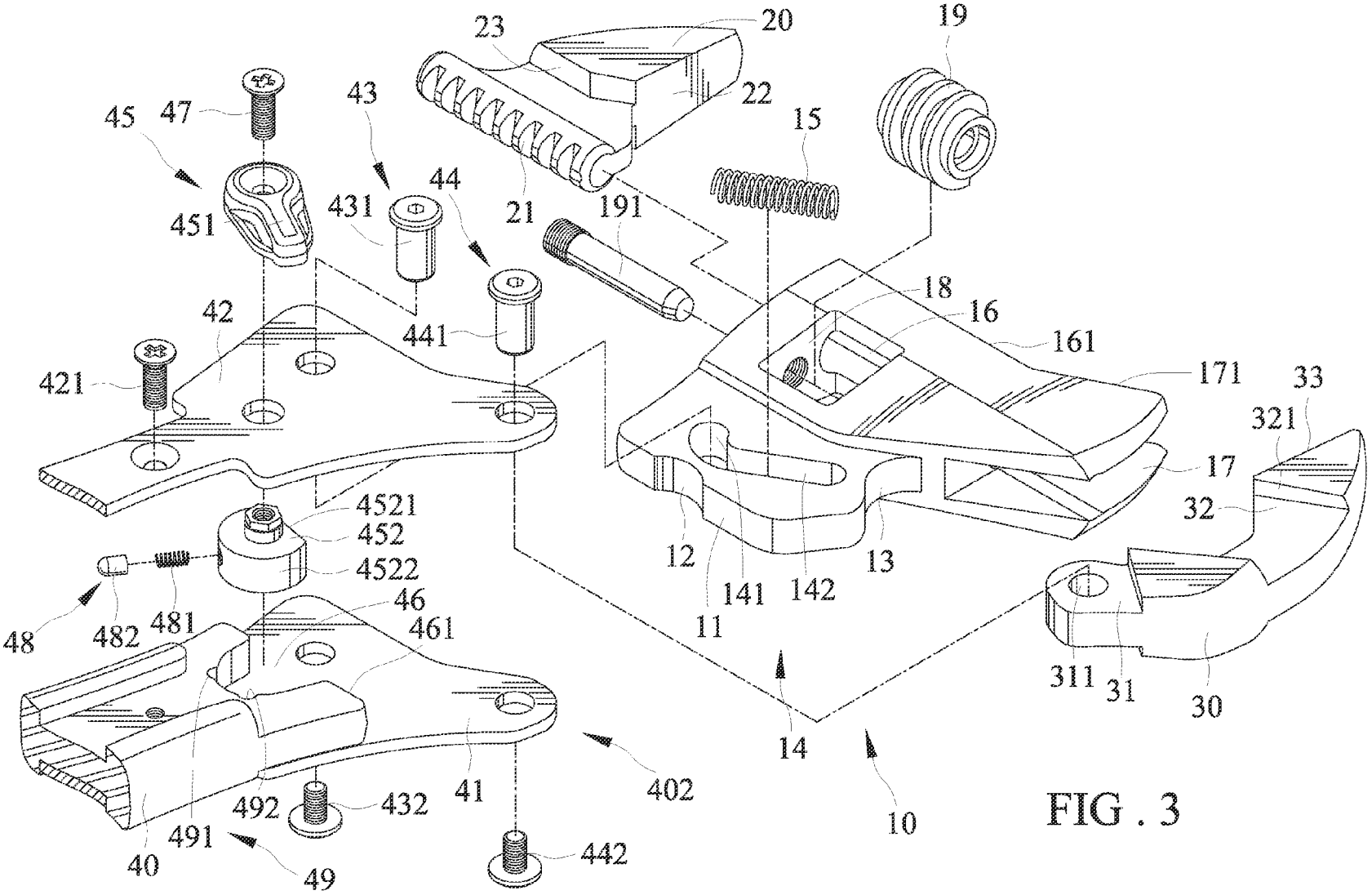
FIG. 3 is another exploded perspective view of the adjustable spanner, taken from a different angle of view than that shown in FIG. 2.
Figure 4:
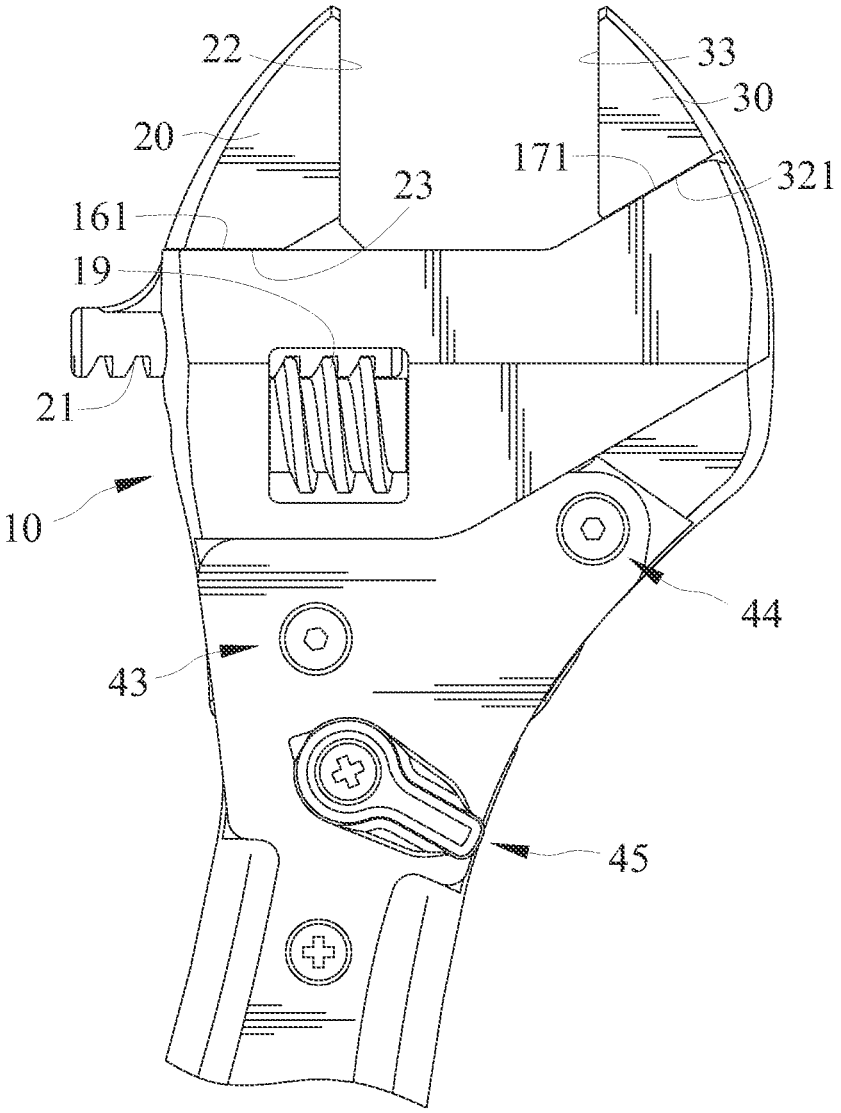
FIG. 4 is a partial, side view of the adjustable spanner of FIG. 1.
Figure 5:
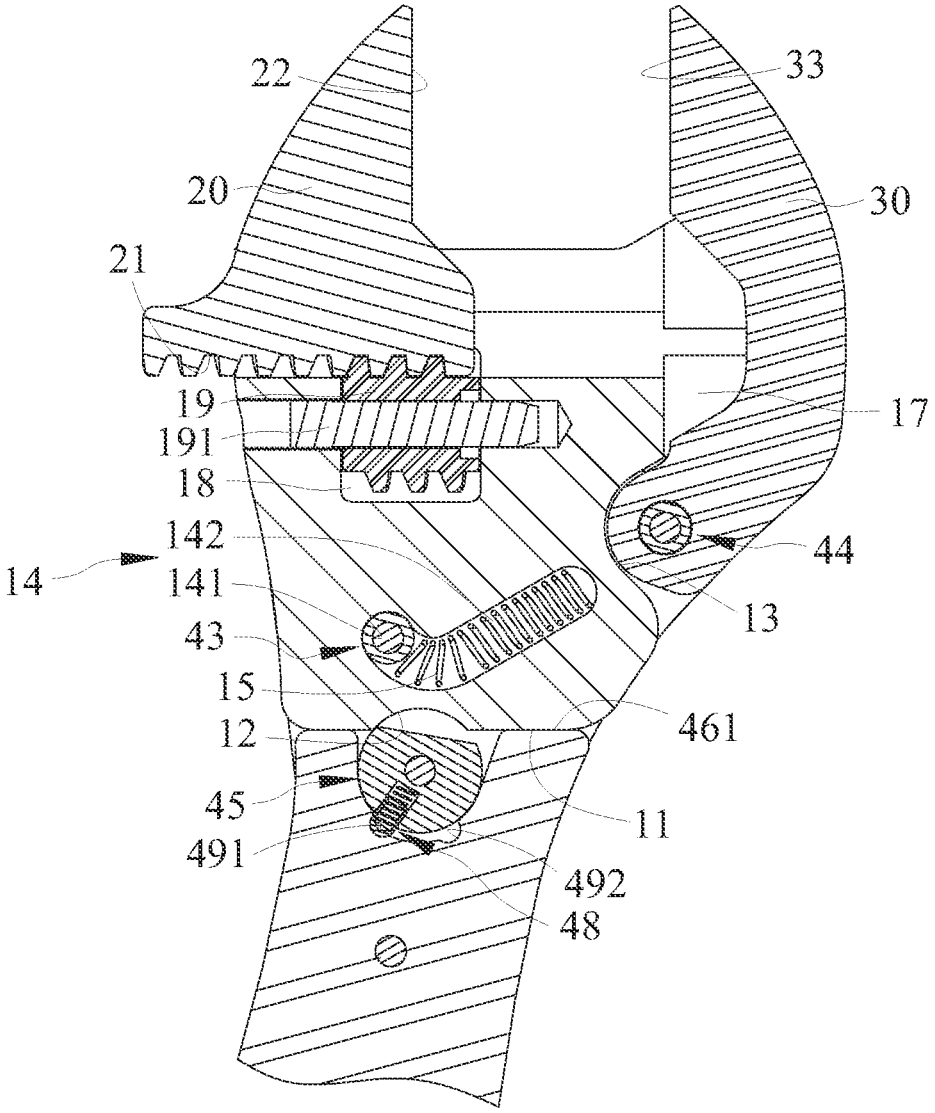
FIG. 5 is a cross-sectional view of FIG. 4.

Referring to FIGS. 1 through 12, an adjustable spanner for quickly turning an object in accordance with a first embodiment of the present invention includes a moving member 10, a first jaw 20, a second jaw 30, and a grip 40.

The moving member 10 is movably joined to the grip 40 and comprises an end edge 11, a recess 12, a cavity 13, an elastic member 15, first and second guiding channels 16 and 17, a room 18, and a worm gear 19. The end edge 11 is defined on the outer periphery of the moving member 10 and extends in a length and provides a contact with the grip 40 when the adjustable spanner is in operation for turning an object "A". The contact between the end edge 11 and the grip 40 allows the adjustable spanner to withstand a relatively large torque force imparted thereto. The end edge 11 and the grip 40 are in line contact with each other. The recess 12 is defined on an end edge 11. Likewise, the recess 12 is defined on the outer periphery of the moving member 10. The cavity 13 is defined in an outer periphery of the moving member 10. The slot 14 defines a first section 141 and a second section 142 connected to and communicating with the first section 141. The first section 141 extends longitudinally in a first direction. The second section 142 extends longitudinally in a second direction that is oblique to the first direction. Furthermore, the first and second sections 141 and 142 extend through the moving member 10. The elastic member 15 comprises a plurality of loops forming a coil spring and is received in the slot 14. The first and second guiding channels 16 and 17 are defined in an end of the moving member 10. Furthermore, the first and second guiding channels 16 and 17 are connected to and communicate with each other. Further, an opening is defined in each of the first and second guiding channels 16 and 17. The opening of the second guiding channel 17 extends from that of the first guiding channel 16. The opening of the first guiding channel 16 is delimited by two walls, and each wall defines an edge 161. The opening of the second guiding channel 17 is delimited by two walls, and each wall defines an edge 171. The edge 171 extends from the edge 161. The edge 161 extends longitudinally in a first direction, and the edge 171 extends longitudinally in a second direction that is oblique to the first direction. A chamber 18 is connected to and communicates with the first guiding channel 16. Chamber 18 extends through the moving member 10 and includes two open ends. A worm gear 19 is received in chamber 18. An axle 191 is inserted through the worm gear 19 and therefore through chamber 18. The axle 191 supports the worm gear 19 and worm gear 19 is rotatable about the axle 19. A first fastening device 43 is inserted in the moving member 10 and the grip 40. The fastening device 43 is received in the slot 14 and abuts against an end of the elastic member 15. The elastic member 15 includes another end abutting against the periphery of the slot 14. Therefore, the fastening device 43 is biased by the elastic member 15. First fastening device 43 utilizes two separate fastening members, namely a first fastening member 431 and a second fastening member 432. The first and second fastening members 431 and 432 are engaged with each other.

The first jaw 20 is jointed to the moving member 10. First jaw 20 includes a joining end 21 connecting to the moving member 10 to join the first jaw 20 to the moving member 10. The joining end 21 is slidably disposed in the first guiding channel 16. Therefore, the first jaw 20 is slidable in the first guiding channel 16. Moreover, the first jaw 20 is adjustably movable to a predetermined position relative to the moving member 10. Namely, the worm gear 19 is used for the adjustment of the first jaw 20. Gears of the worm gear 19 are able to extend out of chamber 18, since chamber 18 is connected to and communicates with the first guiding channel 16 as set forth herein. The joining end 21 of the first jaw 20 includes a plurality of teeth defined thereon that mesh with the gears on the worm gear 19. As the worm gear 19 is rotated, each tooth on the joining end 21 meshes one after another with the worm gear 19, and the first jaw 20 is moved linearly. The first jaw 20 further includes a clamping edge 22. Further, a guiding edge 23 is defined on the first jaw 20. The guiding edge 23 is in movable contact with the edge 161 as the first jaw 20 moves linearly relative to the moving member 10.

The second jaw 30 cooperates with the first jaw 20 to clamp the object "A" when it is turned by the adjustable spanner. Likewise, the second jaw 30 includes a clamping edge 33 defined thereon. When the object "A" is clamped between the first and second jaws 20 and 30, it is clamped by the clamping edges 22 and 33 thereof. Furthermore, the second jaw 30 is joined to the grip 40. Second jaw 30 includes a joining end 31 connecting the grip 40 to join the second jaw 30 to the grip 40. Additionally, the moving member 10 includes the cavity 13 receiving a peripheral side of the joining end 31. Moreover, the second jaw 30 is pivotal relative to the grip 40 and is pivotal about a second fastening device 44, which pivotally joins the second jaw 30 and the grip 40 together. The second fastening device 44 is inserted in the second jaw 30 and the grip 40 to secure them together. The second fastening device 44 is inserted in the joining end 31 of the second jaw 30 and extends therethrough via an orifice 311 defined therein. Furthermore, the first fastening device 44 utilizes two separate fastening members, namely a first fastening member 441 and a second fastening member 442. The first and second fastening members 441 and 442 are engaged with each other. In addition, the second jaw 30 includes a guiding end 32 including a side 321 in movable contact with the edge 171 of the moving member 10 as the moving member 10 is moved relative to the second jaw 30.

The grip 40 includes a first end 401 which a user grasps when using the adjustable spanner and a second end 402 opposite to the first end 401. The moving member 10 is movably joined to the second end 402 of the grip 40. Likewise, the second jaw 30 is pivotally joined to the second end 402 of the grip 40. The second end 402 of the grip 40 includes two connecting plates, namely a first connecting member 41 and a second connecting member 42, cooperated together and disposed in a spaced relationship to hold the moving member 10 and the second jaw 30 therebetween. In this regard, the first and second fastening devices 43 and 44 each engages with both the first and second connecting members 41 and 42 of the grip 40. The first connecting member 41 is integrally formed with the grip 40 while the second connecting member 42 is detachable from the grip 40. The second connecting member 42 is prevented from disengagement from the grip 40 by a fixing member 421. Further, a switch 45 is installed on the grip 40 and is operably moveable. The switch 45 is operated by an input portion 451 defined thereof. The input portion 451 is exposed. One of the first and second connecting members 41 and 42 bears the input portion 451. Furthermore, the switch 45 includes a control portion 452 formed separately from the input portion 451 and is joined to the input portion 451. The control portion 452 is disposed between the first and second connecting members 41 and 42. In this regard, a fixing element 47 is inserted through the input portion 451, one of the first and second connecting members 41 and 42, and the control portion 452 to secure the input portion 451 and control portion 452 together. In addition, the control portion 452 is disposed in a compartment 46 defined in the grip 40. The compartment 46 includes an opening extending between the first and second connecting members 41 and 42.

A positioning device 48 is disposed in the compartment 46. The positioning device 48 is engaged with the switch 45. Positioning device 48 includes a biasing member 481 and a detent 482. The biasing member 481 includes a first end abutting against the switch 45, namely, the control portion 452 of the switch 45. In addition, the control portion 452 includes a circumferential edge defining a first peripheral edge 4521 and a second peripheral edge 4522. The first peripheral edge 4521 is a flat side. The second peripheral edge 4522 is an arcuate side. The first end of the biasing member 481 abuts against the second peripheral edge 4522. The biasing member 481 further includes a second end abutting against the detent 482. The detent 482 includes an end abutting against the peripheral wall of the compartment 46. Further, a positioning zone 49 is defined on the peripheral wall of the compartment 46. In the presently described embodiment, the positioning zone 49 defines two positioning areas, namely, a first positioning area 491 and a second positioning area 492. Each of the first and second positioning areas 491 and 492 is in the form of a cavity. The first and second positioning areas 491 and 492 are spaced from each other.

Therefore, the switch 45 is operably movable between a first position in which the first positioning area 491 receives the detent 482 and a second position in which the second positioning area 492 receiving the detent 482. Moreover, the switch 45 is sustained in either of the first and second positions by the positioning device 48.

A support edge 461 is defined on the grip 40 and abuts the end edge 11 of the moving member 10 when the adjustable spanner is in operation for turning the object "A". As set forth herein, the end edge 11 and the grip 40 are in line contact with each other. Therefore, the end edge 11 is in line contact with the support edge 461.

Figure 6:
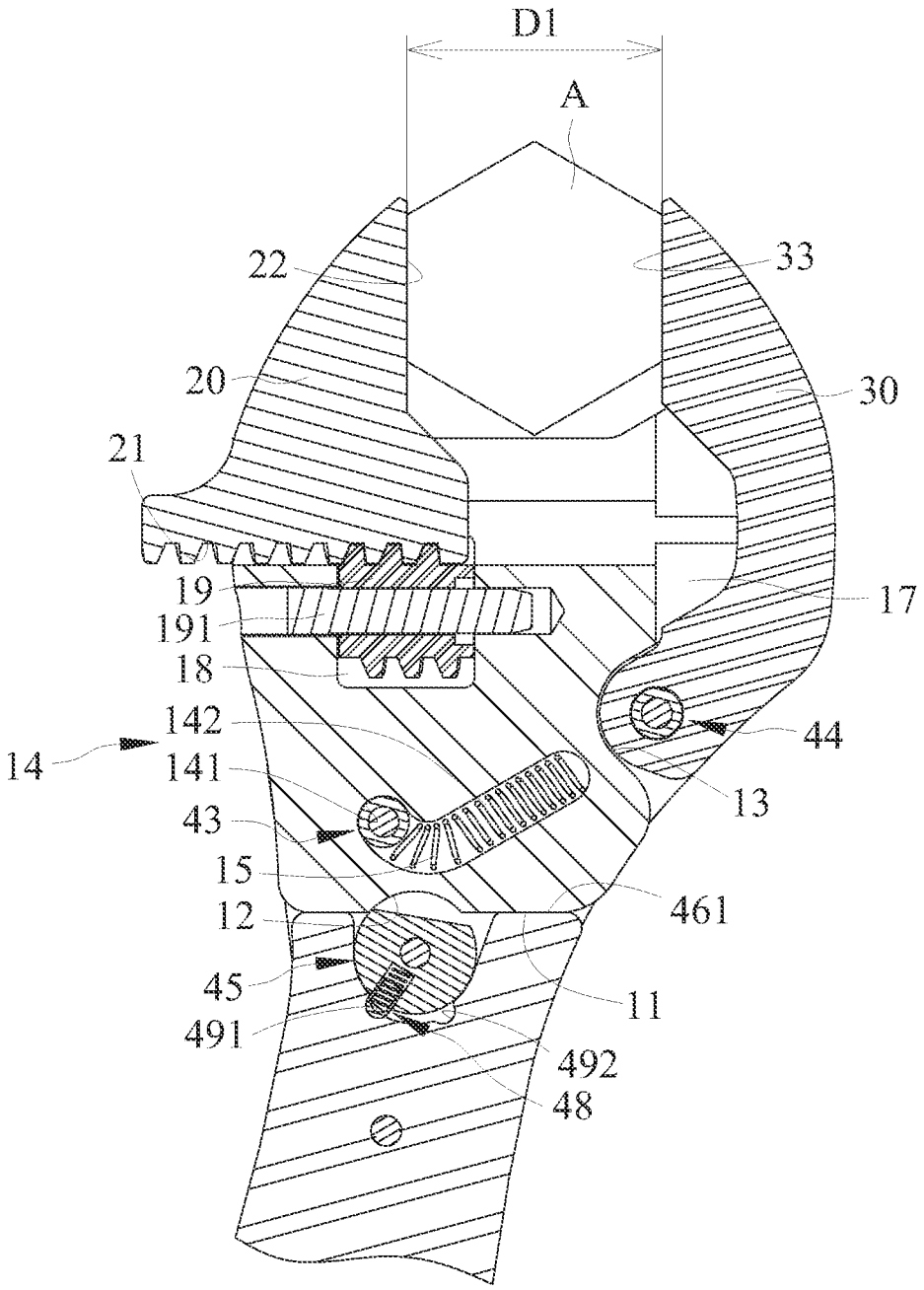
FIG. 6 is an extended cross-sectional view of FIG. 5 showing the adjustable spanner of FIG. 1 including two jaws cooperated to clamp an object, with a first clamping distance D1 defined between the two jaws.
Figure 7:
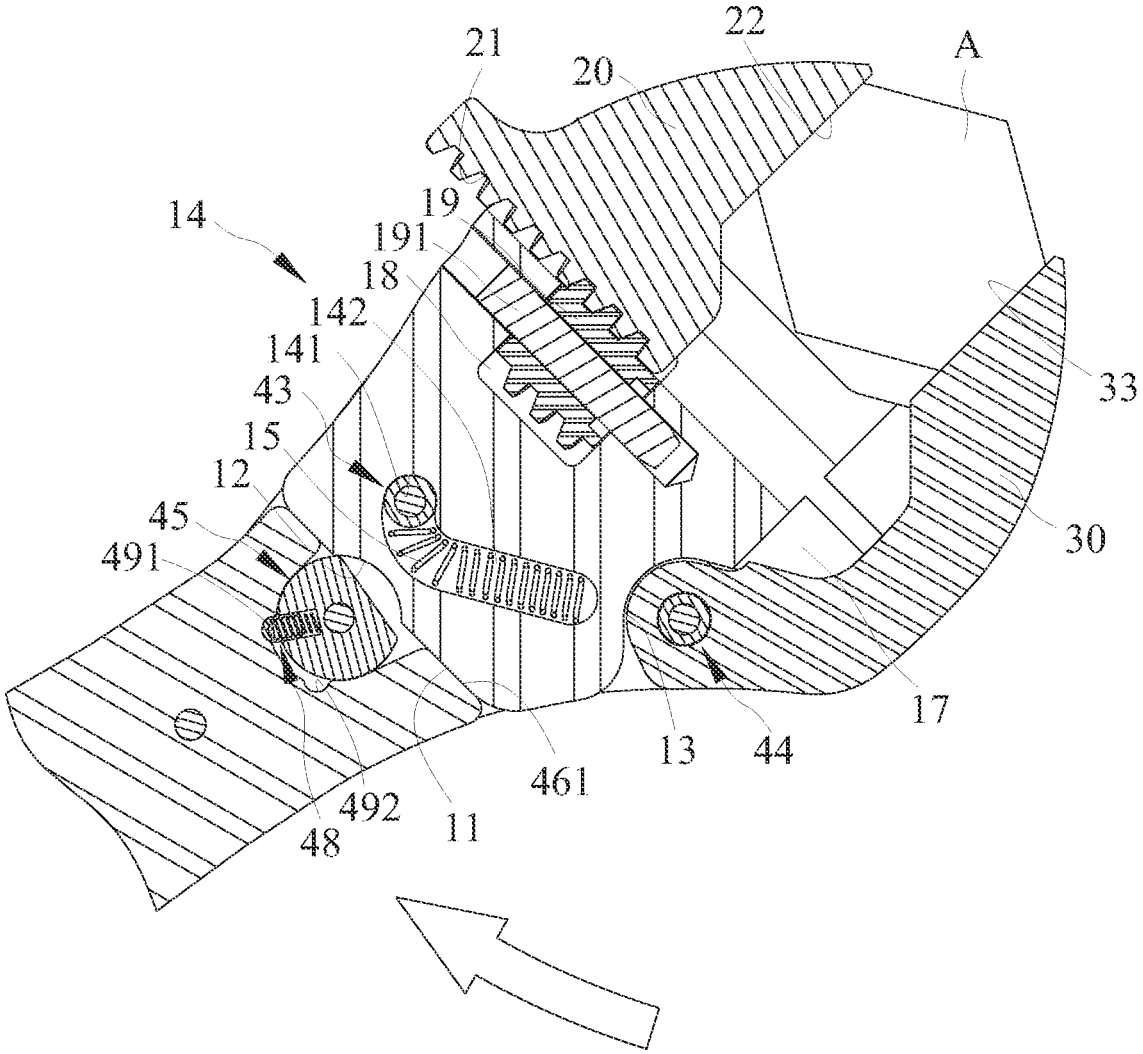
FIG. 7 is an extended cross-sectional view of FIG. 6 showing the adjustable spanner turned in a clockwise direction, with the object turned in the first direction through an angle relative to the position shown in FIG. 6, with the two jaws having the first clamping distance D1 defined therebetween.
Figure 10:
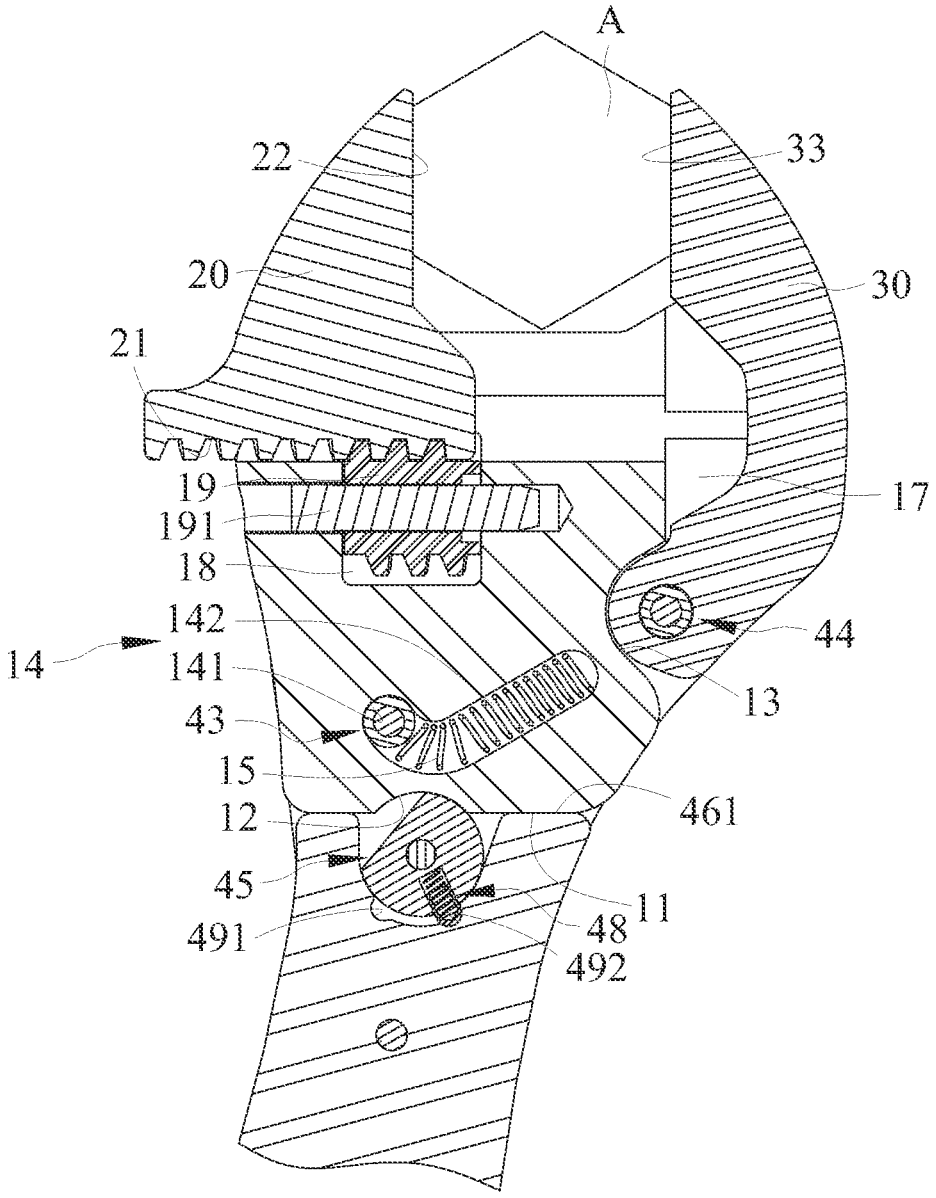
FIG. 10 is a cross-sectional view similar to FIG. 6 but shows a switch of the adjustable spanner in a different operating position than that shown in FIG. 6.
Figure 11:
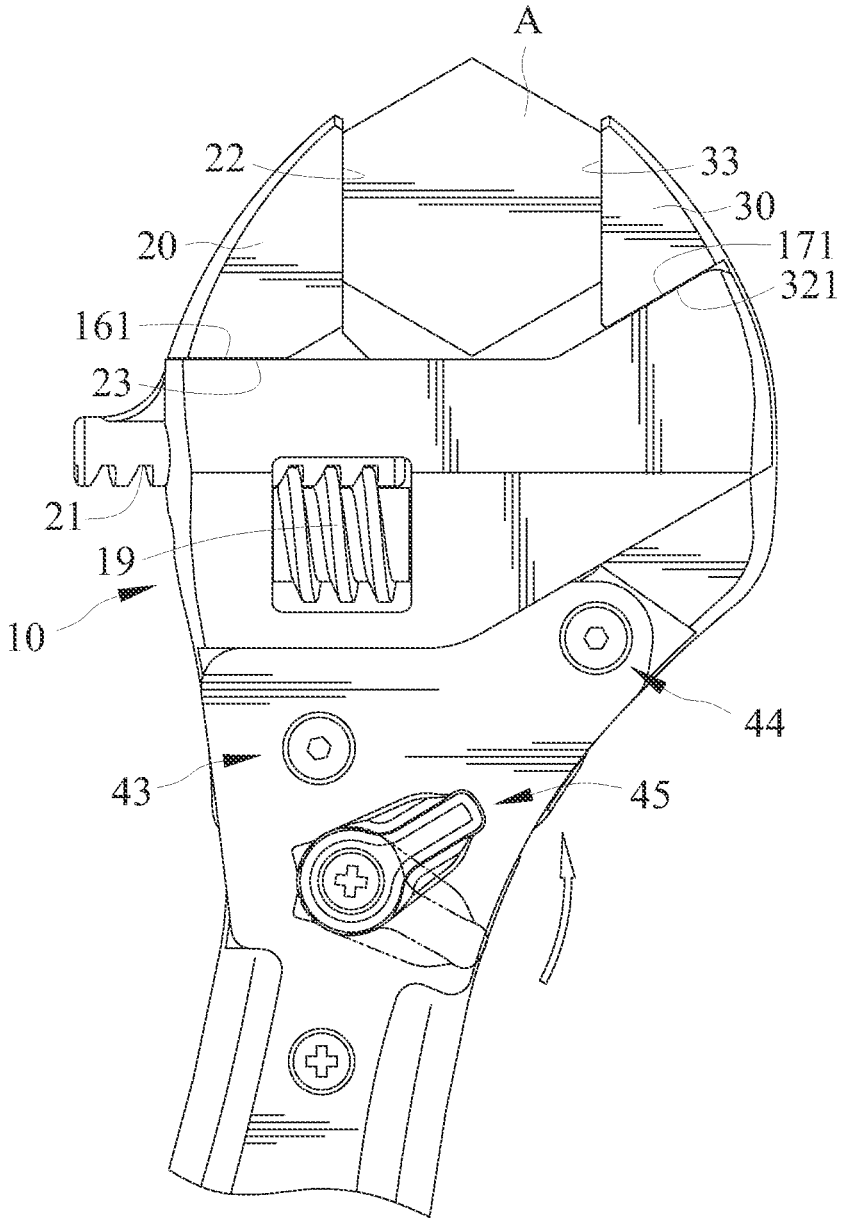
FIG. 11 is a side view of FIG. 10 and shows the operation of the switch.
Figure 12:
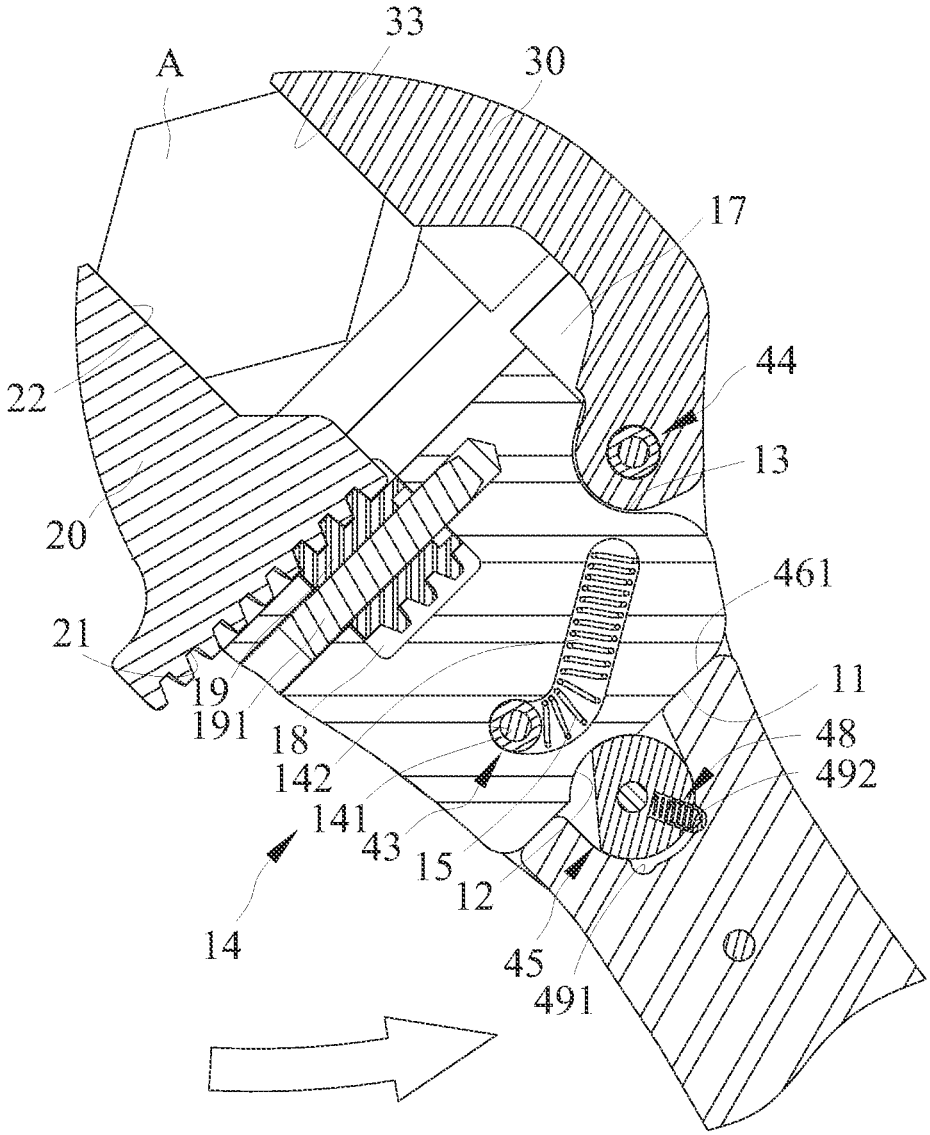
FIG. 12 is a cross-sectional view showing the adjustable spanner turned in a counterclockwise direction, with the object turned in the first direction through an angle relative to the position shown in FIG. 7, with the switch in the position shown in FIG. 10.
Figure 13:
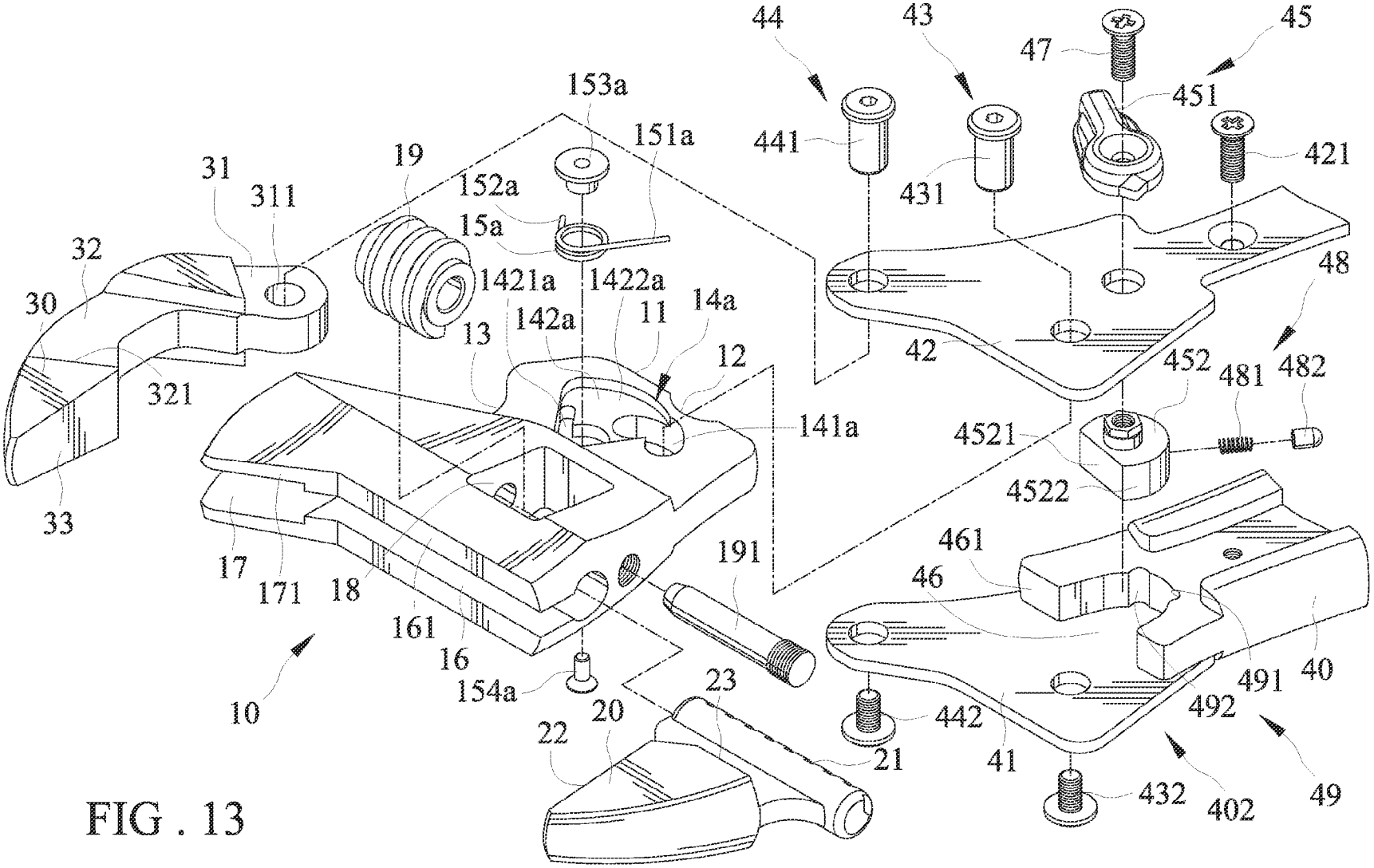
FIG. 13 is an exploded perspective view of an adjustable spanner for quickly turning an object in accordance with a second embodiment of the present invention.
Figure 14:
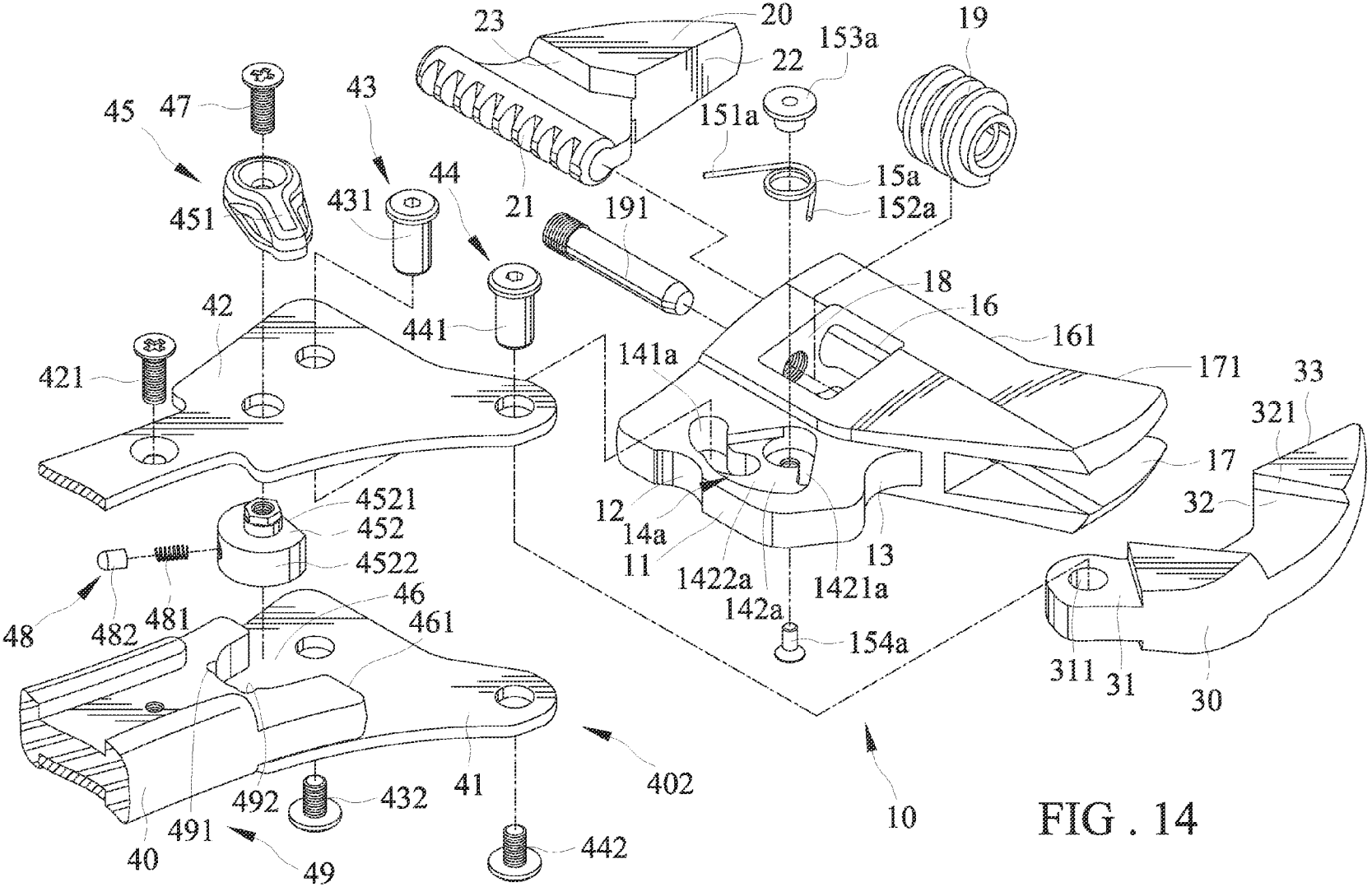
FIG. 14 is another exploded perspective view of the adjustable spanner, taken from a different angle of view than that shown in FIG. 13.
Figure 15:
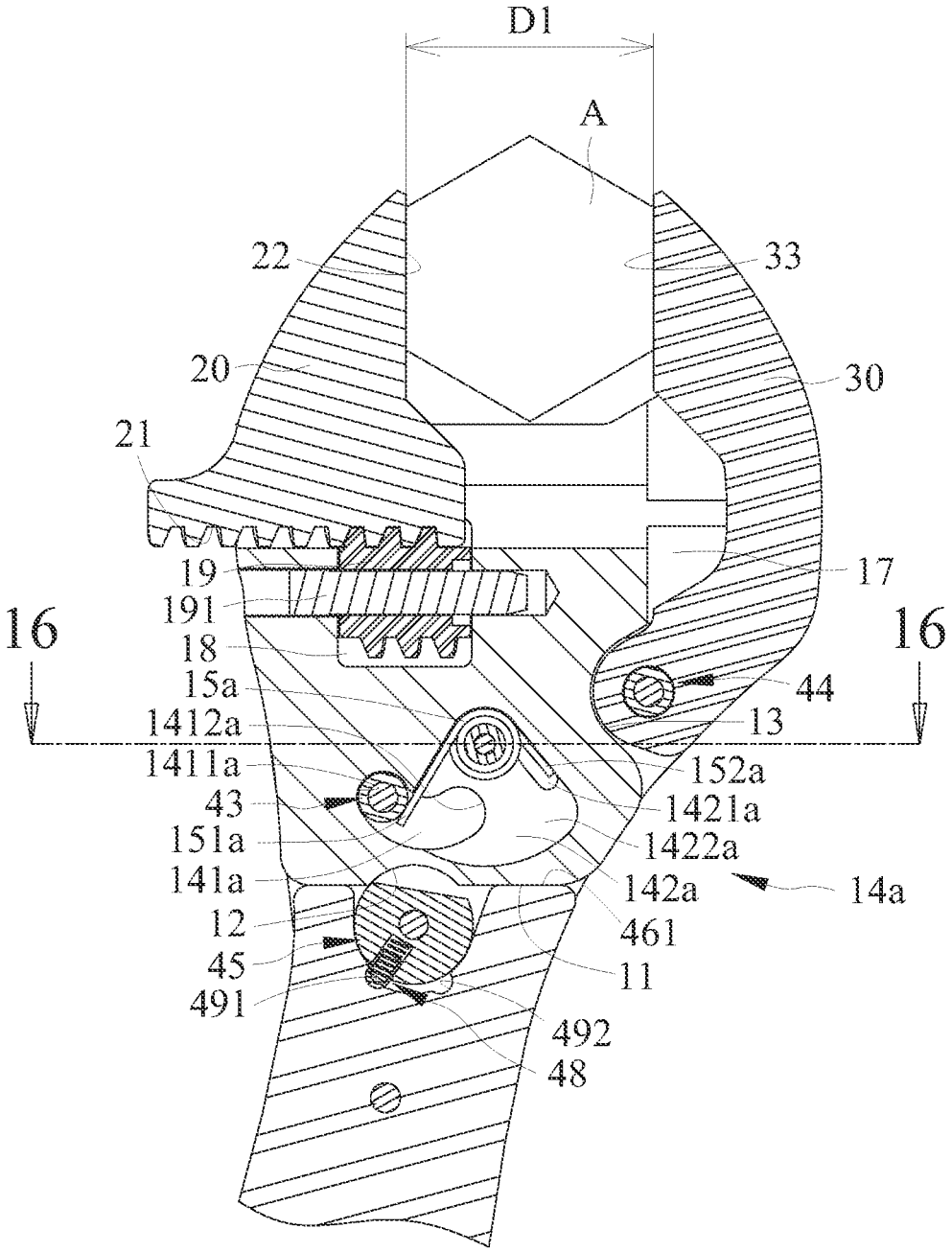
FIG. 15 is a cross-sectional view showing the adjustable spanner of FIG. 13 including two jaws cooperated to clamp an object, with a first clamping distance D1 defined between the two jaws.
Figure 16:
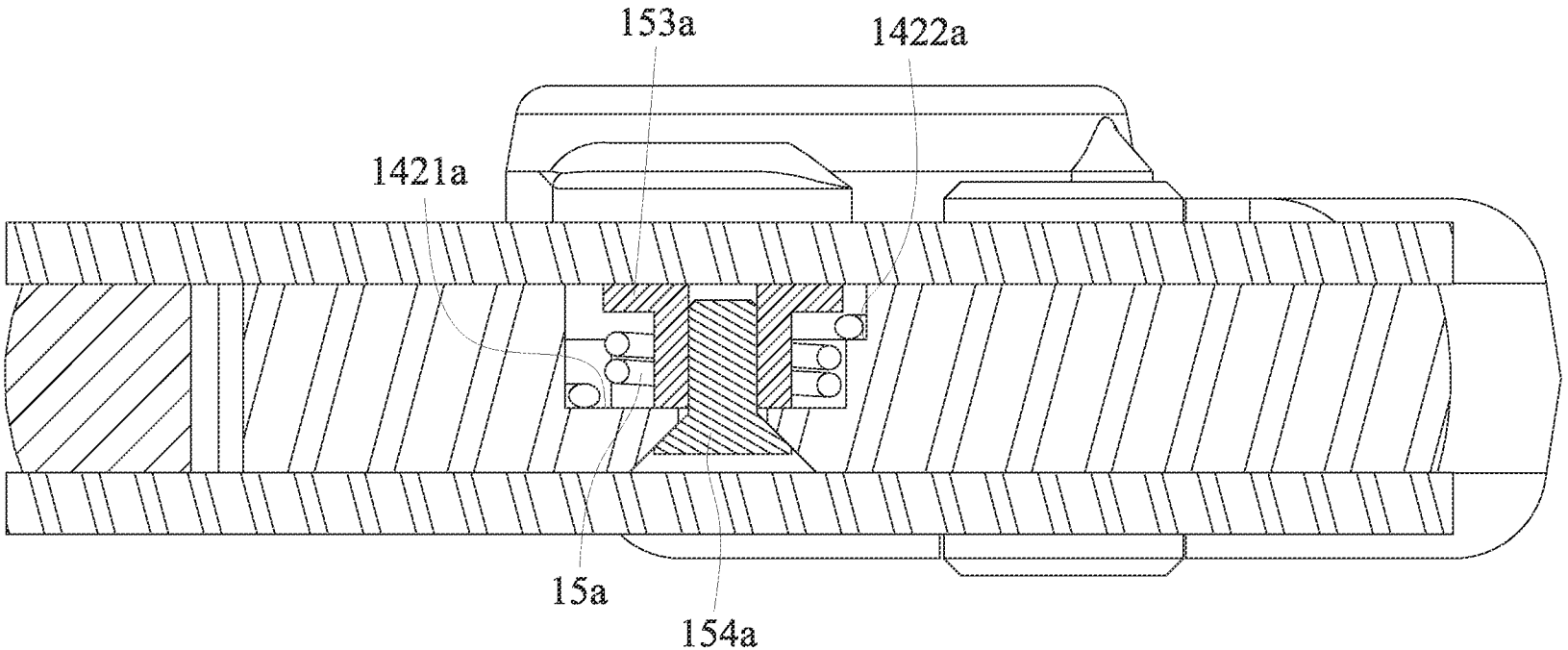
FIG. 16 is a cross-sectional view taken along line 16-16 of FIG. 15.
Figure 17:
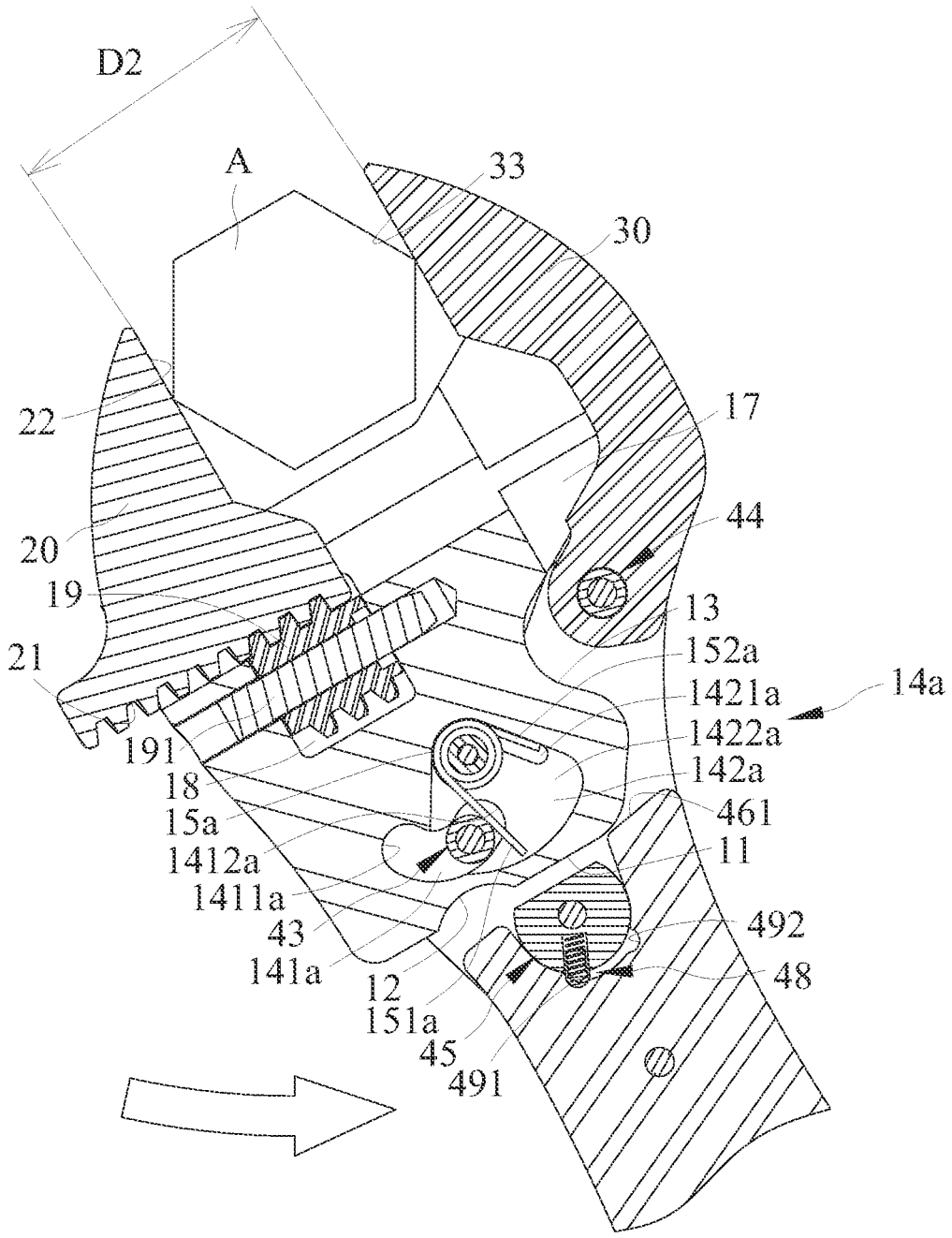
FIG. 17 is an extended cross-sectional view of FIG. 15 showing the adjustable spanner turned in a counterclockwise direction for not turning the object, with the jaws automatically moved away from each other and defining a clamping distance D2 therebetween, with D2 larger than D1.

The adjustable spanner is able to be turned in a direction that the object "A" held between the first and second jaws 20 and 30 is turned, with a relative position between the first and second jaws 20 and 30 fixed, with a fixed first clamping distance "D1" defined between the first and second jaws 20 and 30. Moving member 10 is not moved relative to the grip 40, and the first fastening device 43 is restricted from movement with respect to moving member 10. FIGS. 6 and 7 show the switch 45 is in the first position when the object "A" is turned, and the adjustable spanner is turned in a clockwise direction. FIGS. 10 through 12 show the switch 45 in the second position when the object "A" is turned, and the adjustable spanner is turned in a counterclockwise direction.

Figure 8:
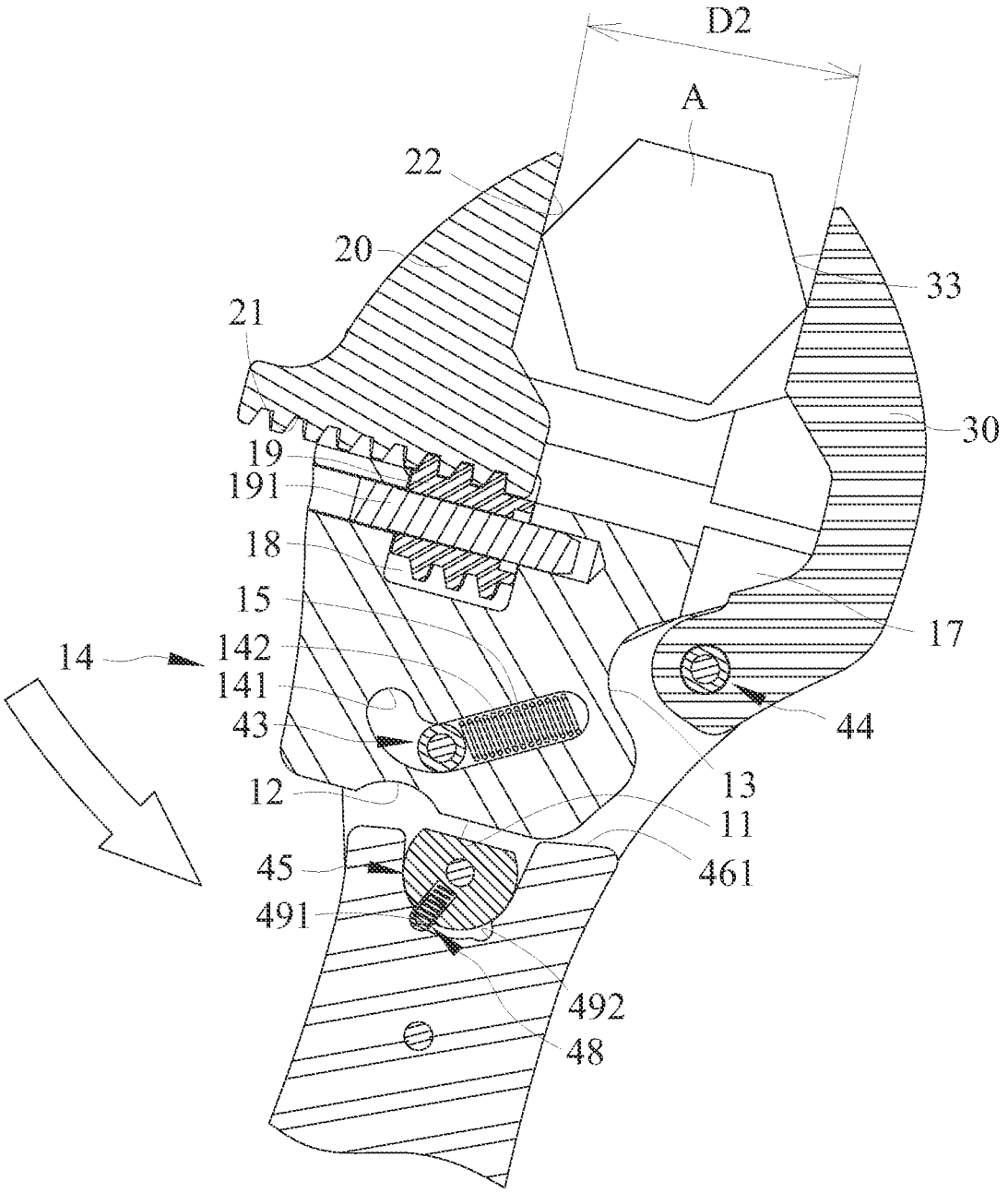
FIG. 8 is an extended cross-sectional view of FIG. 7 showing the adjustable spanner turned in a counterclockwise direction for not turning the object, with the jaws automatically moved away from each other and defining a clamping distance D2 therebetween, with D2 larger than D1.
Figure 9:
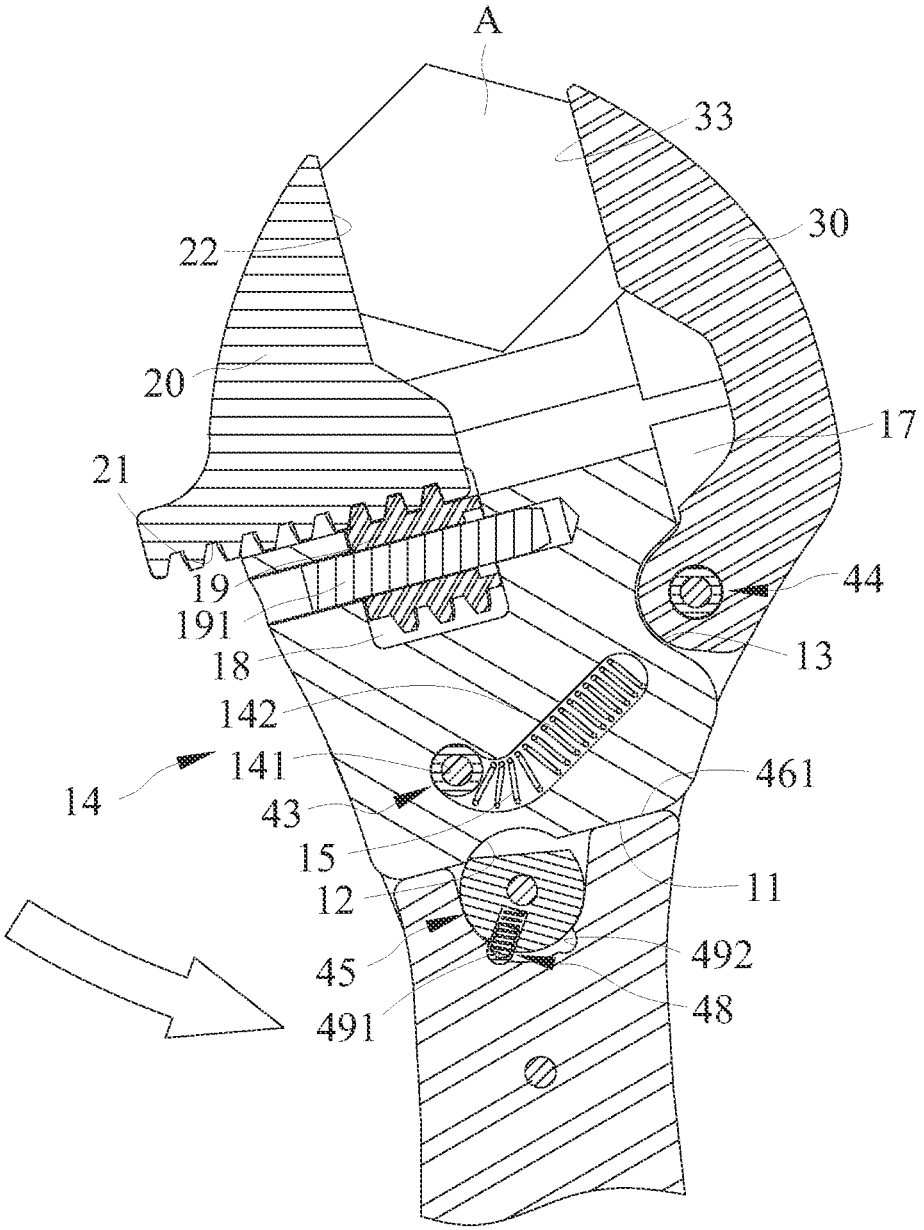
FIG. 9 is an extended cross-sectional view of FIG. 8 showing the adjustable spanner further turned in a clockwise direction, with the two jaws automatically moved towards each other, with the two jaws having the first clamping distance D1 defined therebetween.

Furthermore, the adjustable spanner is able to be turned relatively to the object "A" engaged therewith. The adjustable spanner is turned in a direction which is opposite to the direction for turning the object "A". In this operation, the moving member 10 moves relative to the grip 40 while the first fastening device 43 moves in the slot 14 and compresses the elastic member 15, with the first jaw 20 carried by the moving member 10 to move away from the second jaw 30 until the moving member 10 and first fastening device 43 stop, with a second clamping distance "D2" larger than the first clamping distance "D1" defined between the first and second jaws 20 and 30 when the moving member 10 stops, with the moving member 10 being able to return to the relative position where the first and second jaws 20 and 30 define the first clamping distance "D1" by the elastic member 15. FIG. 8 shows the switch 45 is in the first position and the adjustable spanner is turned in a counterclockwise direction to cause the moving member 10 to move relative to the grip 40 and to cause the first fastening device 43 to move in the slot 14 and compress the elastic member 15, thereby increasing a relative position between the first and second jaws 20 and 30 from "D1" to "D2". FIG. 9 shows that the adjustable spanner is further turned in a counterclockwise direction from FIG. 8, and the object "A" remains in an orientation shown in FIG. 8, and the first and second jaws 20 and 30 have the first clamping distance D1 defined therebetween. Additionally, although not shown, it is understood that when the switch 45 is in the second position, turning the adjustable spanner in a clockwise direction also turns the object "A".

FIGS. 13 through 17 show an adjustable spanner for quickly turning an object in accordance with a second embodiment of the present invention including, instead of a slot 14 and an elastic element 15, a slot 14*a* and an elastic member 15*a*. Otherwise, the elements of the second embodiment are the same as the first embodiment. The slot 14*a* defines a first section 141*a* and a second section 142*a* connected to and communicating with and the first section 141*a*. The first section 141*a* extends through the moving member 10. Furthermore, the first section 141*a* includes a first end 1411*a* and second end 1412*a* and extends from the first end 1411*a* to the second end 1412*a*. Likewise, the first fastening device 43, which is moveable in the slot 14*a*, is movably disposed in the first section 141*a* and between the first and second ends 1411*a* and 1412*a* thereof. The second section 142*a* includes a bottom edge 1421*a* and a platform 1422*a*. The platform 1422*a* extends from the bottom edge 1421*a* and has an extension defined at a level higher than a level of the bottom edge 1421*a* and lower than an opening of the slot 14*a*. Additionally, the elastic member 15*a* includes at least one loop and first and second legs 151*a* and 152*a* extending from two terminal ends of the loop respectively. Furthermore, the elastic member 15*a* is retained in the slot 14*a*. That is, the elastic member 15*a* is disposed on the bottom edge 1421*a*, and a first coupling member 153*a* is inserted through the loop and is supported by the bottom edge 1421*a*, and in addition, a second coupling member 154*a* is cooperated with the first coupling member 154*a* to prevent the first coupling member 153*a* disengaging from the elastic member 15*a*, whereby the elastic member 15*a* is retained in the slot 14*a* by the first and second coupling members 153*a* and 154*a*. Moreover, the elastic member 15*a* includes the first leg 151*a* urged by the first fastening device 43 and the second leg 152*a* urged by the periphery of the second section 142*a* of the slot 14*a*.

While the specific embodiments have been illustrated and described, it should be understood that such embodiments are presented for purposes of example only and that numerous modifications may be made without departing from the scope or spirit of invention, and that all embodiments of the present invention are encompassed herein as may fall within the scope of the accompanying claims.

What is claimed is:

1. An adjustable spanner for quickly turning an object, comprising:

a moving member;

a first jaw adjustably jointed to the moving member;

a second jaw cooperating with the first jaw; and a grip having a first end grippable by a user, in use of the adjustable spanner and a second end opposite to the first end, with the moving member movably joined to the second end and movement thereof restricted by a first fastening device, with the first fastening device being moveable in a slot defined in the moving member, biased by an elastic member disposed in the slot, and fixed to the second end, with the second jaw being pivotally joined to the second end by a second fastening device, and with the second fastening device being inserted in the second end and the second jaw; and wherein the adjustable spanner is able to be turned in a first direction that an object held between the first and second jaws is turned, with a relative position between the first and second jaws fixed, with a fixed first clamping distance defined between the first and second jaws, and wherein the moving member is not moved relative to the grip; and wherein the adjustable spanner is able to be turned relatively to the object, with the adjustable spanner being turned in a second direction opposite to the first direction, with the second jaw pivoting relative to the grip and the moving member about the second fastening device and the moving member moving relative to the grip, with the first jaw carried by, and in a fixed position with respect to, the moving member to move away from the second jaw until the moving member and the first fastening device stop, with a second clamping distance larger than the first clamping distance defined between the first and second jaws when the moving member stops, with the moving member being able to return to the relative position, where the first and second jaws define the first clamping distance, by the elastic member.

2. The adjustable spanner as claimed in claim 1 further comprising a switch installed thereon and operably moveable between a first position in which the adjustable spanner is turned in a first direction to turn the object and in a second direction to move relatively to the object, and a second position in which the adjustable spanner is turned in the first direction and in the second direction to turn the object.

3. The adjustable spanner as claimed in claim 1, wherein the first jaw is adjustably movable to a predetermined position relative to the moving member by a worm gear, with the first jaw moving linearly, with the worm gear operably rotated about an axle inserted therein.

4. The adjustable spanner as claimed in claim 1, wherein the moving member includes an end edge defined on an outer periphery thereof, and the grip includes a support edge defined thereon, and wherein the end edge is in line contact with the support edge when the adjustable spanner is in operation for turning the object.

5. The adjustable spanner as claimed in claim 1, wherein the elastic member includes an end abutting against the first fastening device and another end abutting against a periphery of the slot.

6. The adjustable spanner as claimed in claim 1, wherein the grip includes a first connecting member and a second connecting member disposed in a spaced relationship opposite each other, with the moving member and the second jaw fixed between the first and second connecting members.

7. The adjustable spanner as claimed in claim 6, wherein one of the first and second connecting members is integrally formed with the grip and the other is detachable from the grip.

8. The adjustable spanner as claimed in claim 2 further comprising a positioning device engaging with the switch to sustain the switch in either of the first and second positions, with the positioning device abutting against the switch and a peripheral wall of a compartment defined in the grip.

9. The adjustable spanner as claimed in claim 8, wherein the switch is operated by an input portion defined thereby, wherein the switch includes a control portion, which is formed separately from the input portion and joined to the input portion.

10. The adjustable spanner as claimed in claim 5, wherein the slot defines a first section and a second section connected to and communicating with the first section.

11. The adjustable spanner as claimed in claim 10, wherein the first section extends longitudinally in a first direction, and the second section extends longitudinally in a second direction that is oblique to the first direction of the first section, and the first and second sections extend through the moving member.

12. The adjustable spanner as claimed in claim 10, wherein the first section extends through the moving member and includes a first end and second end and extends from the first end to the second end, and the second section includes a bottom edge and a platform, with the platform extending from the bottom edge and having an extension defined at a level higher than a level of the bottom edge and lower than an opening of the slot.

13. The adjustable spanner as claimed in claim 11, wherein the elastic member includes a plurality of loops.

14. The adjustable spanner as claimed in claim 12, wherein the elastic member includes at least one loop and first and second legs extending from two terminal ends of the at least one loop respectively.

15. An adjustable spanner for quickly turning an object, comprising:

an elongated grip;

a moving member at one end of the grip; and a pair of jaws attached to the one end of the grip, wherein the moving member and the grip are attached so that they are movable with respect to each other over a limited distance between a first position and a second position, wherein the jaws are attached so that, when the moving member and the grip are in the first position, the jaws oppose each other to define a clamping distance therebetween, wherein one of the jaws is connected to the grip through a worm gear that is actuatable about an axis of the worm gear by a user to adjust a position of the one jaw with respect to the other jaw of the pair of jaws and thereby adjust the clamping distance, wherein the other jaw is attached movably with respect to the grip, the moving member, and the one jaw, wherein, in the first position, the moving member and the grip fit cooperatively with each other so that a lock portion retains the other jaw in position with respect to the moving member, and wherein, upon relative movement of the grip and the moving member to the second position, the lock portion releases the other jaw, allowing movement of the other jaw with respect to the moving member.

16. The adjustable spanner as claimed in claim 15, wherein the moving member and the worm gear are arranged so that, in the relative movement of the grip and the moving member to the second position, the moving member carries the worm gear in a fixed position with respect to the moving member along the axis of the worm gear.

* * * * *